US009470409B2

(12) United States Patent
Chen et al.

(10) Patent No.: US 9,470,409 B2
(45) Date of Patent: Oct. 18, 2016

(54) LIGHT-EMITTING DEVICE

(71) Applicants: LITE-ON ELECTRONICS (GUANGZHOU) LIMITED, Guangzhou OT (CN); LITE-ON TECHNOLOGY CORPORATION, Taipei (TW)

(72) Inventors: Chin-Rong Chen, Taipei (TW); Chien-Chang Pei, Taipei (TW); Wen-Kwei Liang, Taipei (TW); Chung-Dao Chen, Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 14/521,991

(22) Filed: Oct. 23, 2014

(65) Prior Publication Data

US 2016/0040867 A1 Feb. 11, 2016

(30) Foreign Application Priority Data

Aug. 5, 2014 (TW) ..... 103126738 A

(51) Int. Cl.
*F21V 29/71* (2015.01)
*F21V 29/503* (2015.01)
(Continued)

(52) U.S. Cl.
CPC ..... *F21V 29/71* (2015.01); *F21K 9/1355* (2013.01); *F21V 3/02* (2013.01); *F21V 17/108* (2013.01);
(Continued)

(58) Field of Classification Search
CPC ..... H05K 7/20963; H05K 7/20972; H01J 61/52; H01J 61/523; H01J 17/28; F21V 29/004; F21V 29/02; F21V 29/2212; F21V 29/002; F21V 29/71; F21V 29/503; F21V 29/89
USPC ..... 313/45–47; 362/294
See application file for complete search history.

(56) References Cited

U.S. PATENT DOCUMENTS 7,670,028 B2 * 3/2010 Liu ..... F21K 9/00 362/234
7,993,025 B2 * 8/2011 Chiu ..... F21V 29/83 362/249.02

(Continued)

FOREIGN PATENT DOCUMENTS

CN 101846260 A 9/2010
CN 102032481 A 4/2011

(Continued)

OTHER PUBLICATIONS

Taiwanese Office Action dated May 21, 2015.

(Continued)

*Primary Examiner* — Anne Hines
*Assistant Examiner* — Jose M Diaz
(74) *Attorney, Agent, or Firm* — Rabin & Berdo, P.C.

(57) ABSTRACT

A light-emitting device comprising a heat dissipation carrier, a circuit board, a light-emitting element, a side heat conduction plate, an insulation shell and a light cover is provided. The circuit board is disposed on the heat dissipation carrier. The light-emitting element is disposed on the circuit board. The light cover is directly engaged with the heat dissipation carrier. The side heat conduction plate is engaged with the heat dissipation carrier and comprises a transverse plate and a side plate. The transverse plate carries the circuit board. The side plate is connected with the transverse plate. The insulation shell covers the side plate of the side heat conduction plate.

19 Claims, 13 Drawing Sheets

(51) Int. Cl.

| | |
|---|---|
| ***F21V 29/89*** | (2015.01) |
| ***F21K 99/00*** | (2016.01) |
| ***F21V 17/10*** | (2006.01) |
| ***F21V 23/00*** | (2015.01) |
| ***F21V 3/02*** | (2006.01) |
| *F21V 19/00* | (2006.01) |
| *F21Y 101/02* | (2006.01) |

(52) U.S. Cl.

CPC ..... *F21V 23/006* (2013.01); *F21V 23/009* (2013.01); *F21V 29/503* (2015.01); *F21V 29/89* (2015.01); *F21V 19/0055* (2013.01); *F21Y 2101/02* (2013.01)

(56) References Cited

U.S. PATENT DOCUMENTS

| | | | | |
|---|---|---|---|---|
| 8,087,456 | B2 * | 1/2012 | Wei | B23P 15/26 165/185 |
| 8,449,154 | B2 * | 5/2013 | Uemoto | F21K 9/135 257/98 |
| 8,502,468 | B2 * | 8/2013 | Li | F21K 9/1355 313/318.01 |
| 8,760,042 | B2 * | 6/2014 | Sakai | F21K 9/1355 313/324 |
| 9,062,830 | B2 * | 6/2015 | Le | F21V 3/00 |
| 2007/0084595 | A1 * | 4/2007 | Lin | H01L 23/3672 165/185 |
| 2009/0009999 | A1 * | 1/2009 | Wang | F21K 9/00 362/249.01 |
| 2010/0091487 | A1 * | 4/2010 | Shin | F21S 48/328 362/235 |
| 2010/0110691 | A1 * | 5/2010 | Hsu | F21V 29/004 362/294 |
| 2010/0186937 | A1 * | 7/2010 | Liang | F21V 29/85 165/185 |
| 2011/0116267 | A1 * | 5/2011 | Huang | F21V 29/004 362/249.02 |
| 2011/0232886 | A1 * | 9/2011 | Liang | F21K 9/1355 165/185 |
| 2011/0273895 | A1 * | 11/2011 | Uemoto | F21K 9/135 362/430 |
| 2012/0194055 | A1 * | 8/2012 | Wu | F21K 9/00 313/46 |
| 2012/0273180 | A1 * | 11/2012 | Tseng | F21V 29/773 165/185 |
| 2013/0063945 | A1 * | 3/2013 | Wu | F21K 9/1355 362/249.02 |
| 2013/0286666 | A1 * | 10/2013 | Bakk | F04F 7/00 362/363 |
| 2014/0043815 | A1 * | 2/2014 | Chuang | F21V 29/2262 362/249.02 |

FOREIGN PATENT DOCUMENTS

| | | | |
|---|---|---|---|
| JP | 2010-092831 | A | 4/2010 |
| JP | 2012-028286 | A | 2/2012 |
| TW | M451485 | U | 4/2013 |
| TW | M470201 | U | 1/2014 |

OTHER PUBLICATIONS

Japanese Office Action with reorganized translation dated Aug. 25, 2015.

* cited by examiner

LIGHT-EMITTING DEVICE

This application claims the benefit of Taiwan application Serial No. 103126738, filed Aug. 5, 2014, the subject matter of which is incorporated herein by reference.

BACKGROUND OF THE INVENTION

1. Field of the Invention

The invention relates in general to a light-emitting device, and more particularly to a light-emitting device having a heat dissipation carrier.

2. Description of the Related Art

When a conventional light-emitting device illuminates, the light-emitting element of conventional light-emitting device will generate heat at the same time. In general, the generated heat is convected or conducted to an exterior through a heat dissipation plate of the light-emitting device.

In general, the heat dissipation plate is formed by using the spinning process. However, since the spinning process is subjected to several restrictions and only can manufacture the heat dissipation with simple structure and appearance, the heat dissipation efficiency of the heat dissipation plate is thus restricted.

SUMMARY OF THE INVENTION

The invention is directed to a light-emitting device. In an embodiment, the heat dissipation carrier of the light-emitting device has high manufacturability and may form a diversity of heat dissipation structures.

According to one embodiment the present invention, a light-emitting device is provided. The light-emitting device comprises a heat dissipation carrier, a circuit board, a light-emitting element, a side heat conduction plate, an insulation shell and a light cover. The circuit board is disposed on the heat dissipation carrier. The light-emitting element is disposed on the circuit board. The light cover is directly engaged with the heat dissipation carrier. The side heat conduction plate is engaged with the heat dissipation carrier and comprises a transverse plate and a side plate. The transverse plate carries the circuit board. The side plate is connected with the transverse plate. The insulation shell covers the side plate of the side heat conduction plate.

The above and other aspects of the invention will become better understood with regard to the following detailed description of the preferred but non-limiting embodiment (s). The following description is made with reference to the accompanying drawings.

DETAILED DESCRIPTION OF THE INVENTION

Figure 1A:
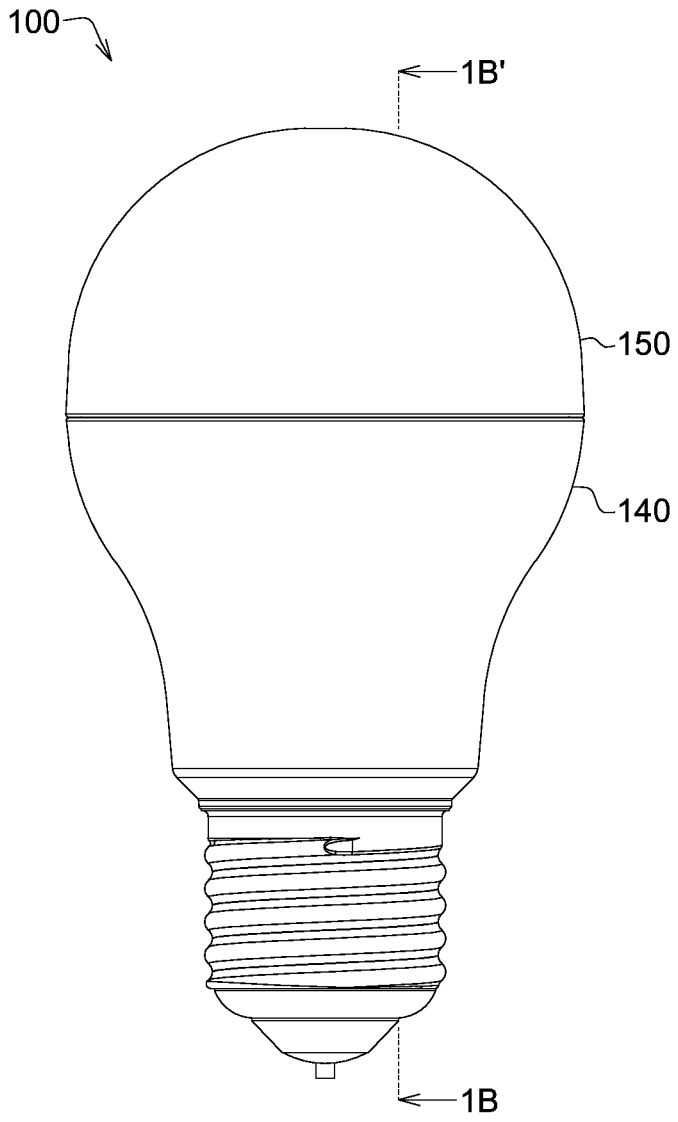
FIG. 1A illustrates an appearance diagram of a light-emitting device according to an embodiment of the invention.
Figure 1B:
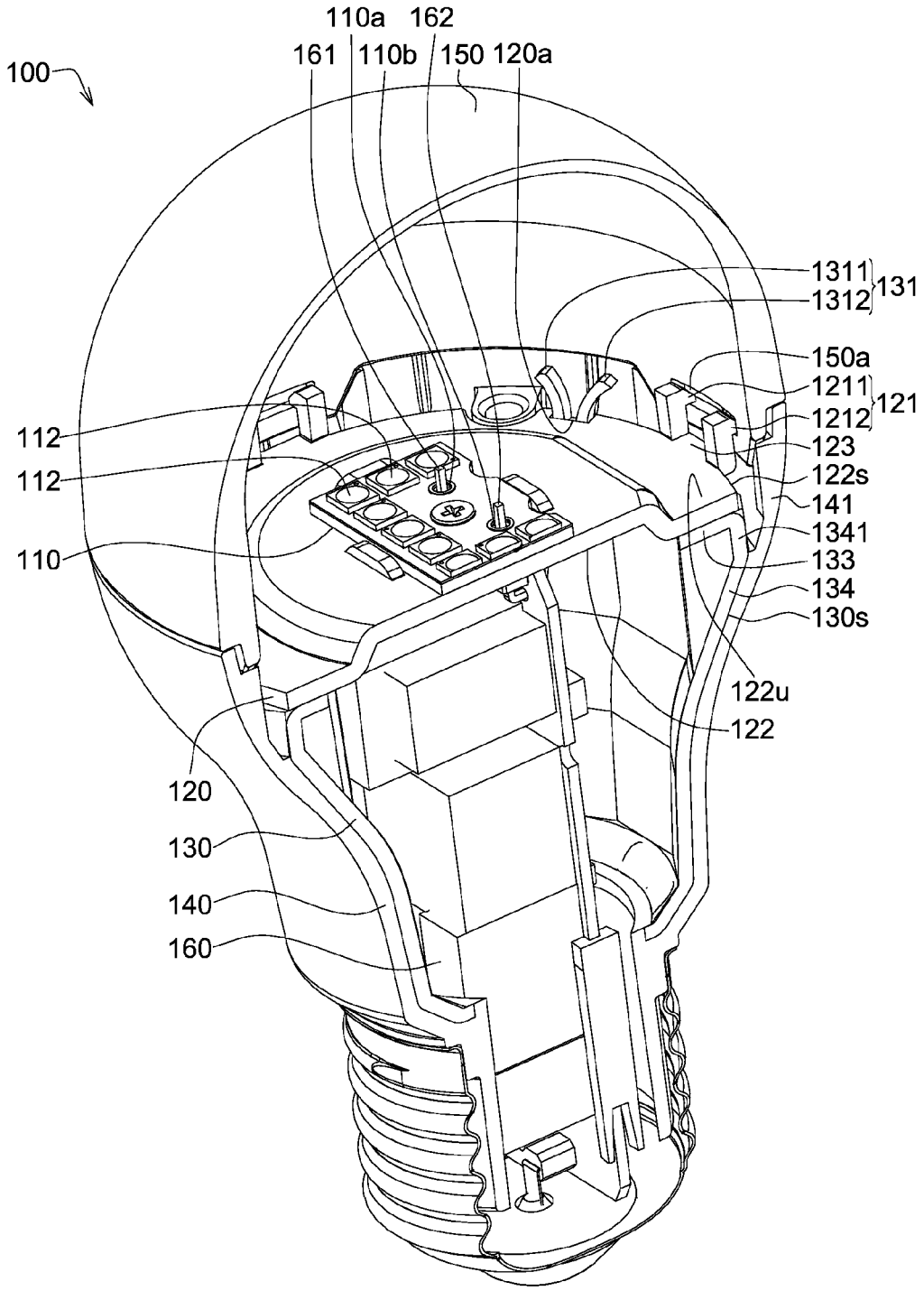
FIG. 1B illustrates a cross-sectional view of the light-emitting device of FIG. 1A viewed along direction 1B-1B'.

Referring to FIGS. 1A and 1B. FIG. 1A illustrates an appearance diagram of a light-emitting device according to an embodiment of the invention. FIG. 1B illustrates a cross-sectional view of the light-emitting device of FIG. 1A viewed along direction 1B-1B'.

The light-emitting device 100 comprises a circuit board 110, a plurality of light-emitting element 112, a heat dissipation carrier 120, a side heat conduction plate 130, an insulation shell 140, a light cover 150 and a driver 160.

In the present embodiment, the circuit board 110 and the heat dissipation carrier 120 are independent elements. In another embodiment, the circuit board 110 and the heat dissipation carrier 120 may be integrated as one element.

As indicated in FIG. 1B, the circuit board 110 is disposed on the heat dissipation carrier 120. The light-emitting element 112, which may be realized by such as a light emitting diode or other types of light-emitting element, is disposed on the circuit board 110 and electrically connected with the wire (not illustrated) of the circuit board 110. To put it in greater details, the circuit board 110 may be realized by a printed circuit board. The heat of the light-emitting element 112 may be conducted to the heat dissipation carrier 120 and the side heat conduction plate 130, such that the circuit board 110 and/or the light-emitting element 112 may be cooled down.

The circuit board 110 has a first through hole 110*a* and a second through hole 110*b*. The driver 160 comprises a first pin 161 and a second pin 162. The first pin 161 and the second pin 162 respectively penetrate the first through hole 110*a* and the second through hole 110*b*. Although it is not illustrated in the diagram, one solder may electrically connect the first pin 161 with the wire of the circuit board 110, and another solder may electrically connect the second pin 162 with the wire of the circuit board 110, such that the circuit board 110 may be electrically connected with the driver 160. In the present embodiment, the first pin 161 and the second pin 162 are hard pins and maintain an erect state so that the first pin 161 and the second pin 162 may penetrate the first through hole 110*a* and the second through hole 110*b*. In an embodiment, the first pin 161 and the second pin 162 may be made of aluminum, copper or a combination thereof. In terms of dimension, the outer diameter of the first pin 161 is less than the inner diameter of the first through hole 110*a* but greater than a half of the inner diameter of the first through hole 110*a*, such that the first pin may maintain an erect state. The relationship between the outer diameter of the second pin 162 and the inner diameter of the second through hole 110*b* is similar to that between the outer diameter of the first pin 161 and the inner diameter of the first through hole 110*a*, and the similarities are not repeated here.

As indicated in FIG. 1B, the heat dissipation carrier 120 may be made of materials with high thermal conductivity such as copper, aluminum, etc. In the present embodiment, the heat dissipation carrier 120 may be formed by a sheet by using a sheet metal processing. The heat dissipation carrier 120 is not equipped with wires, that is, the heat dissipation carrier 120 may not comprise any circuit function. The sheet metal processing includes such as pressing, bending or a combination thereof. In comparison to spinning process, the sheet metal processing has high formability and may form complicated or versatile structures to achieve various designs and space matching of peripheral elements. In another embodiment, the wire (not illustrated) may be formed in the heat dissipation carrier 120 to form a heat dissipation circuit board with the heat dissipation carrier 120. The heat dissipation carrier 120 is such as a metal substrate or a glass fiber substrate. The metal substrate may be realized by such as a metal core (MCPCB), and the glass fiber substrate may be realized by such as an FR4 substrate, a CEM1 substrate or a CEM3 substrate.

The heat dissipation carrier 120 may be engaged with the side heat conduction plate 130. For example, the heat dissipation carrier 120 has at least one engaging through hole 120*a*, and the side heat conduction plate 130 comprises at least one engaging portion 131. Each engaging portion 131 comprises a first engaging arm 1311 and a second engaging arm 1312 opposite to the first engaging arm 1311. The first engaging arm 1311 and the second engaging arm 1312 penetrate the engaging through hole 120*a* and expand outwardly, such that the distance between the first engaging arm 1311 and the second engaging arm 1312 is greater than the inner diameter of the engaging through hole 120*a* for the first engaging arm 1311 and the second engaging arm 1312 to be engaged with the engaging through hole 120*a*. In the present embodiment, the engaging through hole 120*a* is a notch of the heat dissipation carrier 120, and extends to the lateral surface 122*s* of the heat dissipation carrier 120. In another embodiment, the engaging through hole 120*a* does not have to extend to the lateral surface 122*s* of the heat dissipation carrier 120. Like the heat dissipation carrier 120, the side heat conduction plate 130 may be formed by using the metallic press process. The side heat conduction plate 130 is formed by using the sheet metal processing, which may form complicated or versatile structures (such as the first engaging arm 1311 and the second engaging arm 1312) to achieve various designs and space matching of peripheral elements.

The insulation shell 140 covers the side heat conduction plate 130. In terms of manufacturing method, in the injection molding process for manufacturing the insulation shell 140, the side heat conduction plate 130 may be buried in the injection mold beforehand, and after ejection molding is completed, the insulation shell 140 covers at least a part of an outer surface 130*s* and/or at least a part of an inner surface of the side heat conduction plate 130.

The side heat conduction plate 130 comprises a transverse plate 133 and a side plate 134 interconnected with the transverse plate 133. In the present embodiment, the transverse plate 133 and the side plate 134 are integrally formed in one piece, but the embodiment of the invention is not limited thereto. The transverse plate 133 carries the circuit board 110. The upper portion 1341 of the side plate 134 is connected with the transverse plate 133 but is separated from the upper portion 141 of the insulation shell 140, such that the thickness of the upper portion 141 of the insulation shell 140 is close to that of other parts of the insulation shell 140, and the insulation shell 140 may have a uniform thickness. Thus, after the injection molding process was completed and the insulation shell 140 was cooled down, the insulation shell 140 will not generate shrink marks which may easily be generated when the thickness difference is too large. Besides, in the present embodiment, the transverse plate 133 extends towards the middle of the side heat conduction plate 130, that is, the transverse plate 133 is bended inwardly. In another embodiment, the transverse plate 133 may extend in a direction away from the middle of the side heat conduction plate 130. Under such design, the transverse plate 133 is bent outwardly.

The light cover 150 may be directly or indirectly engaged with the heat dissipation carrier 120. In terms of direct engaging, the light cover 150 has at least one engaging recess 150*a*, the heat dissipation carrier 120 comprises at least one hook 121, and each hook 121 is engaged with a corresponding engaging recess 150*a*. The heat dissipation carrier 120 further comprises a carrier plate 122 and a protruding portion 123. The carrier plate 122 has an upper surface 122*u* which carries the circuit board 110. The protruding portion 123 is projected outwardly from the lateral surface 122*s* of the carrier plate 122. The hook 121 comprises a first sub-hook 1211 and a second sub-hook 1212. The first sub-hook 1211 and the second sub-hook 1212 are connected with two opposite sides of the protruding portion 123 respectively and are projected to the engaging recess 150*a* in a direction away from the upper surface 122*u* of the carrier plate 122 to be directly engaged with the engaging recess 150*a*. In the present embodiment, the engaging recess 150*a* may be realized by a through hole or a groove. In another embodiment, the hook 121 may omit the first sub-hook 1211 or the second sub-hook 1212. Since the heat dissipation carrier 120 is formed by using the metallic press process, the first sub-hook 1211 or the second sub-hook 1212 may be easily formed.

Figure 2:
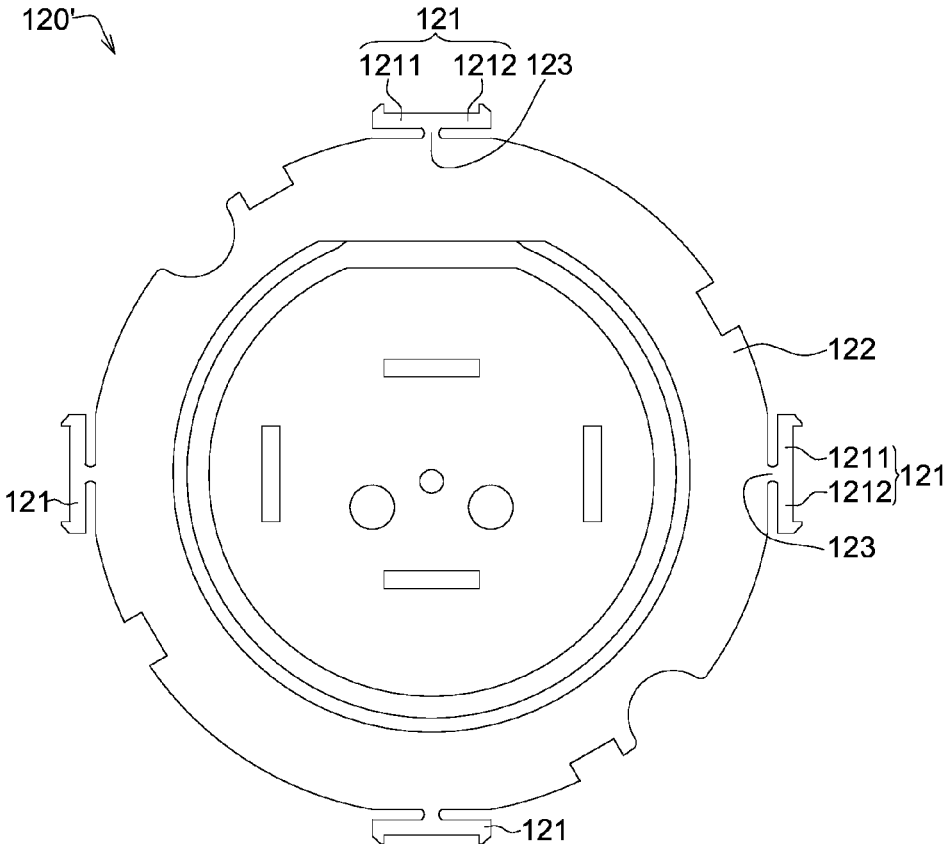
FIG. 2 illustrates an expansion diagram of the heat dissipation carrier of FIG. 1B.

FIG. 2 illustrates an expansion diagram of the heat dissipation carrier of FIG. 1B. In terms of the method for manufacturing the heat dissipation carrier, firstly an expansion plate 120' may be formed by using the sheet metal processing. The expansion plate 120' comprises at least one hook 121, a carrier plate 122 and at least one protruding portion 123. The protruding portion 123 extends outwardly from the outer side 122*s* of the carrier plate 122. Each hook 121 comprises a first sub-hook 1211 and a second sub-hook 1212. The first sub-hook 1211 and the second sub-hook 1212 are connected with two opposite sides of the protruding portion 123 respectively, and substantially extend along the outer side 122*s* of the carrier plate 122.

Figure 3A:
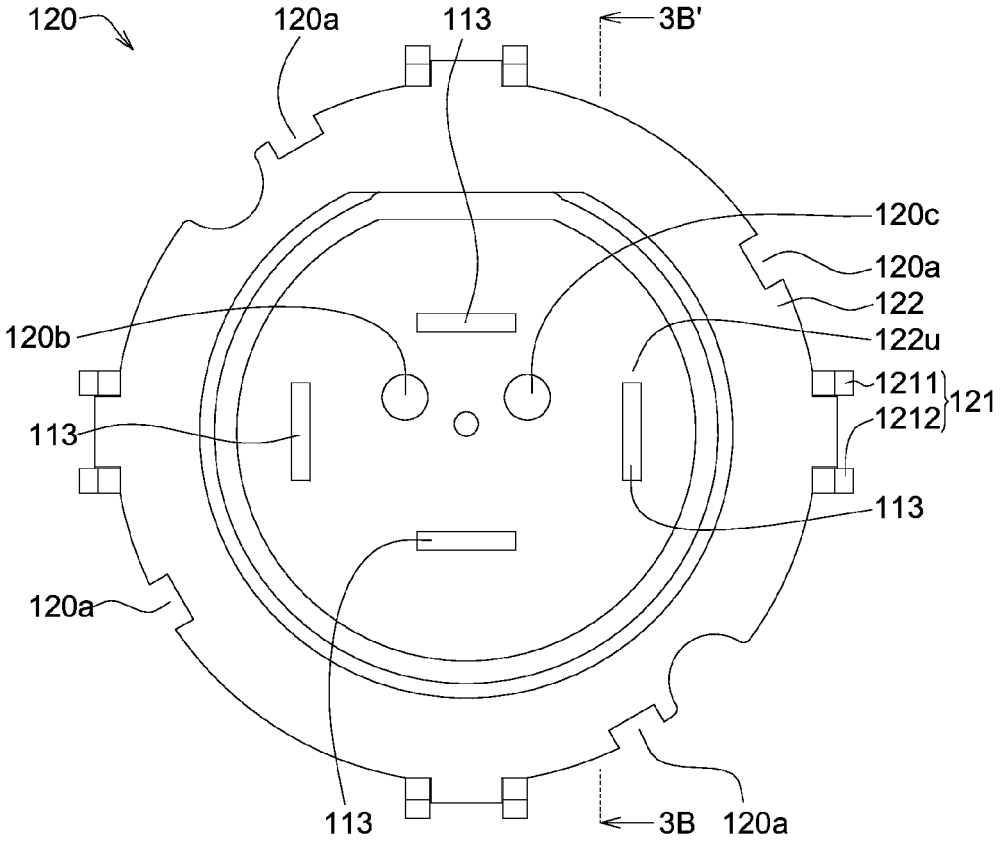
FIG. 3A illustrates a top view of the heat dissipation carrier of FIG. 2 whose expansion plate is folded.
Figure 3B:
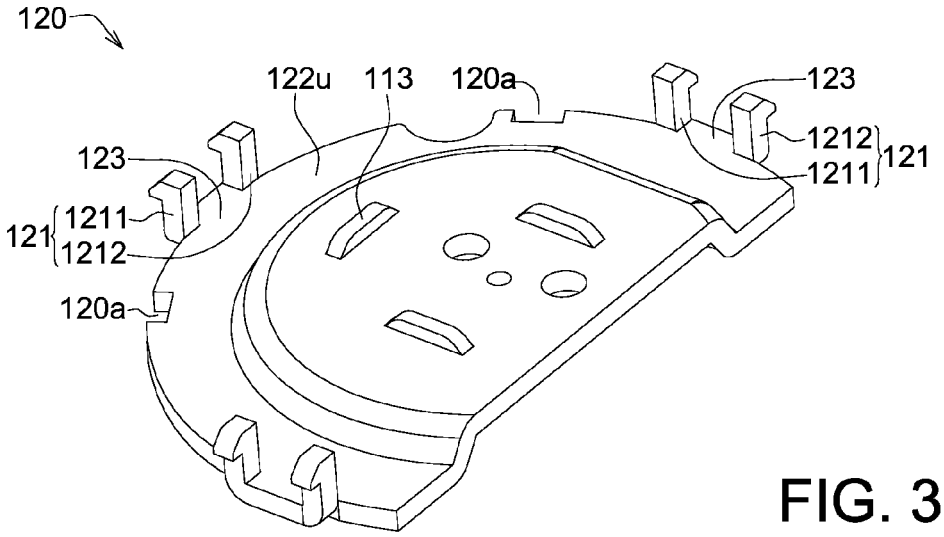
FIG. 3B illustrates a cross-sectional view of the heat dissipation carrier of FIG. 3A viewed along direction 3B-3B'.

Referring to FIGS. 3A and 3B. FIG. 3A illustrates a top view of the heat dissipation carrier of FIG. 2 whose expansion plate is folded. FIG. 3B illustrates a cross-sectional view of the heat dissipation carrier of FIG. 3A viewed along direction 3B-3B'. The first sub-hook 1211 and the second sub-hook 1212 of the expansion plate 120' of FIG. 2 are folded, such that the first sub-hook 1211 and the second sub-hook 1212 are projected over the upper surface 122*u*. Thus, when the heat dissipation carrier 120 and the light cover 150 are jointed, the first sub-hook 1211 and the second sub-hook 1212 are substantially aligned with the engaging recess 150*a* of the light cover 150 and may thus be engaged with the engaging recess 150*a* of the light cover 150 as indicated in FIG. 1B.

As indicated in FIG. 3A, the heat dissipation carrier 120 comprises a plurality of stopper protrusions 113. The circuit board 110 of FIG. 1B may be located within the region enclosed by the stopper protrusions 113 to fix the relative position between the circuit board 110 and the heat dissipation carrier 120 and avoid the circuit board 110 moving on the upper surface 122*u* of the heat dissipation carrier 120.

As indicated in FIG. 3A, the heat dissipation carrier 120 has a third through hole 120*b* and a fourth through hole 120*c*, and the first pin 161 (illustrated in FIG. 1B) and the second pin 162 (illustrated in FIG. 1B) respectively penetrate the third through hole 120*b* and the fourth through hole 120*c*, and further are projected from the first through hole 110*a* (illustrated in FIG. 1B) and the second through hole 110*b* (illustrated in FIG. 1B) of the circuit board 110.

Figure 4A:
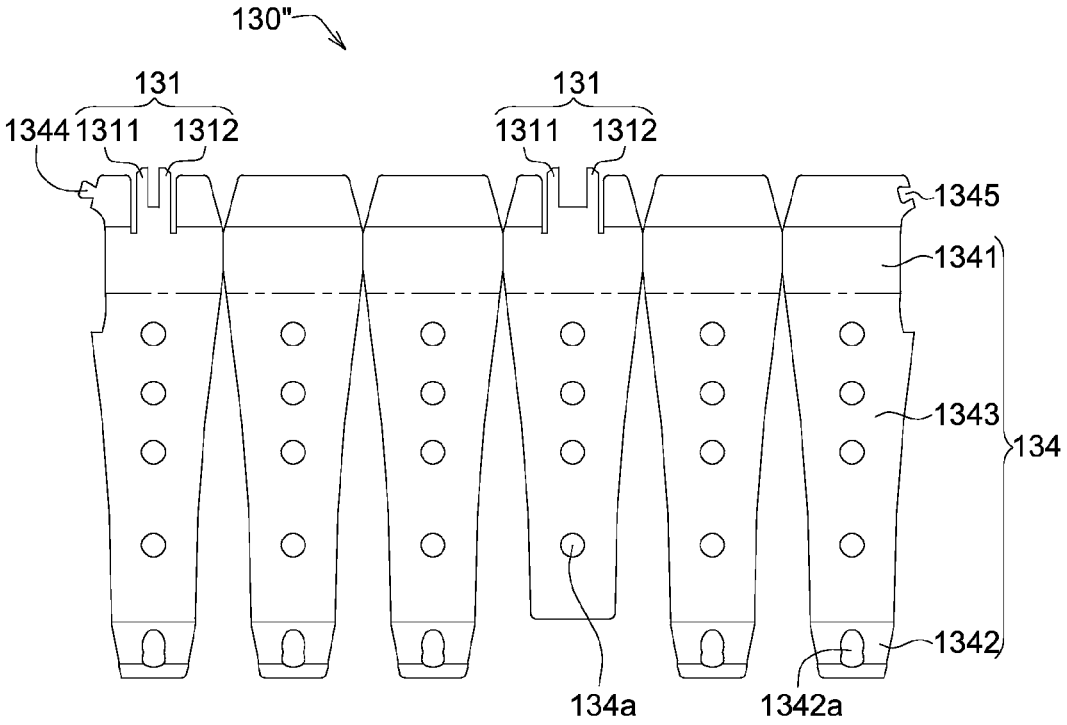
FIG. 4A illustrates an expansion diagram of the side heat conduction plate of FIG. 1B.
Figure 4B:
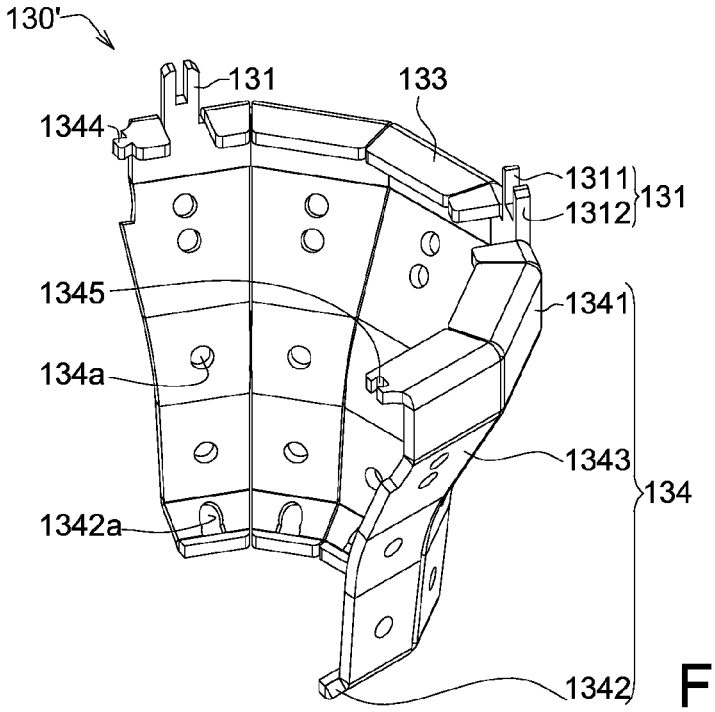
FIG. 4B illustrates a folding diagram of the side heat conduction plate of FIG. 4A.

Referring to FIGS. 4A and 4B. FIG. 4A illustrates an expansion diagram of the side heat conduction plate of FIG. 1B. FIG. 4B illustrates a folding diagram of the side heat conduction plate of FIG. 4A.

As indicated in FIG. 4A, the side heat conduction plate 130 of FIG. 1B may be formed by a plurality of sub heat dissipation plates 130' of FIG. 4B. In terms of the method for manufacturing the sub heat dissipation plate 130', firstly, an expansion plate 130" is formed by using the sheet metal processing. The expansion plate 130" comprises at least one engaging portion 131, a transverse plate 133 and a side plate 134. Each engaging portion 131 comprises a first engaging arm 1311 and a second engaging arm 1312 opposite to the first engaging arm 1311. The side plate 134 comprises an upper portion 1341, a lower portion 1342 and a connection plate 1343 connecting the upper portion 1341 with the lower portion 1342. The sub heat dissipation plate 130' is formed by using the sheet metal processing, which has higher formability and may form complicated or versatile structures to achieve various designs and space matching of peripheral elements.

As indicated in FIG. 4B, the expansion plate 130" of FIG. 4A is folded to form the sub heat dissipation plate 130' of FIG. 4B. After the expansion plate 130" of FIG. 4A was folded, the transverse plate 133 of the folded sub heat dissipation plate 130' is bent inwardly and is placed substantially in a horizontal orientation for carrying the circuit board 110 (illustrated in FIG. 1B). After the expansion plate 130" of FIG. 4A was folded, the upper portion 1341 of the side plate 134 is substantially placed in a vertical orientation, and the lower portion 1342 of the side plate 134 is bent inwardly and placed in an inclined orientation. After the expansion plate 130" of FIG. 4A was folded, the connection plate 1343 has a curved surface. Furthermore, the lower portion 1342 has a plurality of positioning through holes 1342*a*. In the injection molding process of the insulation shell 140 (illustrated in FIG. 1), the through holes 1342*a* may be positioned by the positioning pins of the mold (not illustrated) to fix the relative position between the sub heat dissipation plate 130' and the mold, such that the insulation shell 140 may exactly cover the sub heat dissipation plate 130'. Furthermore, the connection plate 1343 has a plurality of mold flow through holes 134*a*. The mold flow through holes 134*a* are for the purpose of mold flow. To put it in greater details, in the injection molding process of the insulation shell 140, the liquid-state material of the insulation shell flows through the mold flow through hole 134*a* and covers the inner surface and the outer surface of the sub heat dissipation plate 130'. In addition, the mold flow through hole 134*a* may also be used as a positioning hole whose function is similar to that of the positioning through hole 1342*a*, and the similarities are not repeated here.

Figure 5:
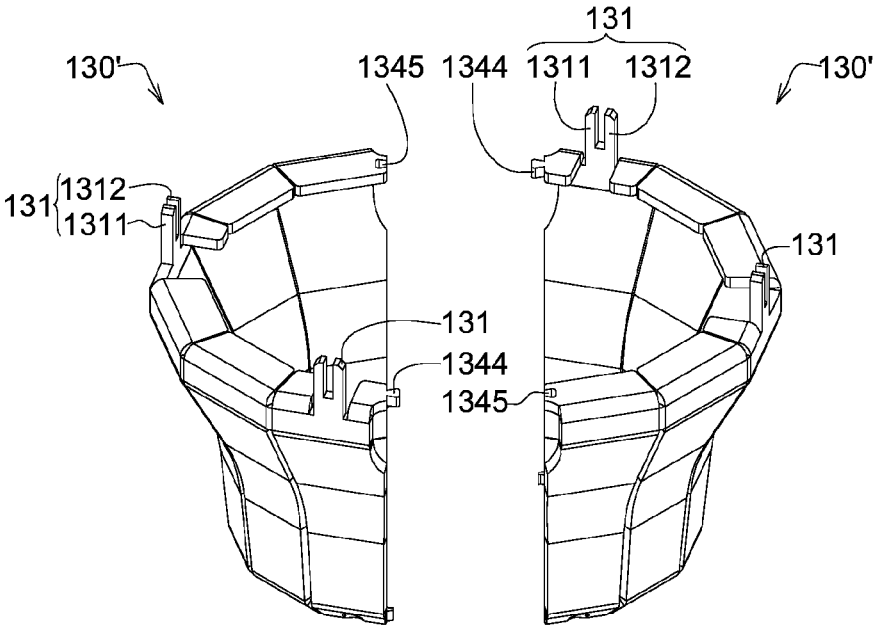
FIG. 5 illustrates an assembly diagram of several sub heat dissipation plates of FIG. 4B.

FIG. 5 illustrates an assembly diagram of several sub heat dissipation plates of FIG. 4B. In the present embodiment, two sub heat dissipation plates 130' are jointed to form the side heat conduction plate 130 of FIG. 1B. In greater details, each sub heat dissipation plate 130' comprises a protrusion 1344 and a recess 1345. The protrusion 1344 and the recess 1345 of one sub heat dissipation plate 130' are respectively engaged with the recess 1345 and the protrusion 1344 of an adjacent sub heat dissipation plate 130', such that the two adjacent sub heat dissipation plates 130' are engaged with each other. In another embodiment, the side heat conduction plate 130 may be formed by folding a single-piece expansion plate. Under such design, the single-piece expansion plate may directly be folded to form the side heat conduction plate 130 without employing any engaging operation.

Figure 6A:
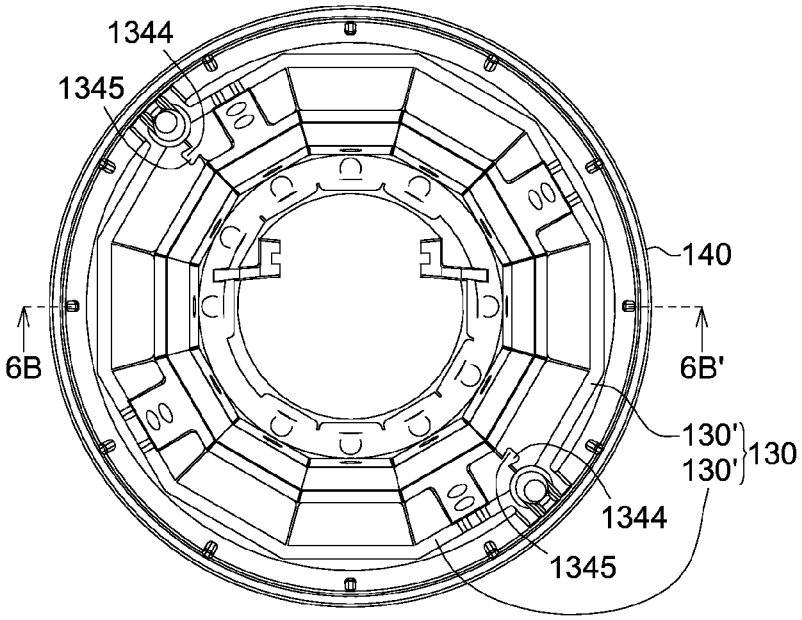
FIG. 6A illustrates a top view of an insulation shell covering the side heat conduction plate.
Figure 6B:
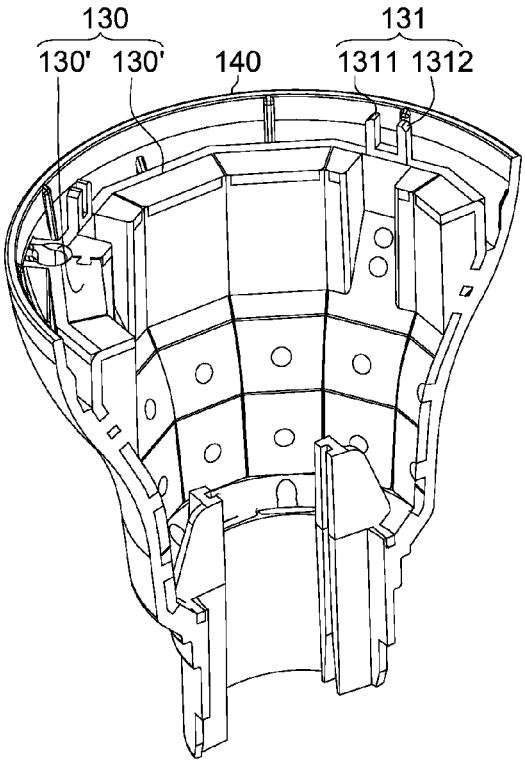
FIG. 6B illustrates a cross-sectional view of the side heat conduction plate of FIG. 6A viewed along direction 6B-6B'.

Referring to FIGS. 6A and 6B. FIG. 6A illustrates a top view of an insulation shell covering the side heat conduction plate. FIG. 6B illustrates a cross-sectional view of the side heat conduction plate of FIG. 6A viewed along direction 6B-6B'.

As indicated in FIG. 6A, two sub heat dissipation plates 130' are jointed to form an annular-shaped side heat conduction plate 130. Then, the insulation shell 140 may be formed by using such as double injection molding process may to cover at least a part of the outer surface and/or at least a part of the inner surface of the side heat conduction plate 130 as indicated in FIG. 6B.

As indicated in FIG. 6B, after the side heat conduction plate 130 was covered by the insulation shell 140, the first engaging arm 1311 and the second engaging arm 1312 of the engaging portion 131 have not yet expanded outwardly, such that the heat dissipation carrier 120 of FIG. 1B may be disposed on the side heat conduction plate 130 with the engaging through hole 120*a* being aligned with the engaging portion 131 of the side heat conduction plate 130. Then, a force is applied to make the first engaging arm 1311 and the second engaging arm 1312 expand outwardly (as indicated in FIG. 1B) and make the distance between the first engaging arm 1311 and the second engaging arm 1312 greater than the inner diameter of the engaging through hole 120*a*, such that the engaging portion 131 is engaged with the engaging through hole 120*a*.

The engaging mechanism for engaging the light cover and the insulation shell according to the embodiments of the invention in not limited to the structure exemplified in FIG. 1B. Other engaging mechanisms are exemplified below with accompanying drawings.

Figure 7A:
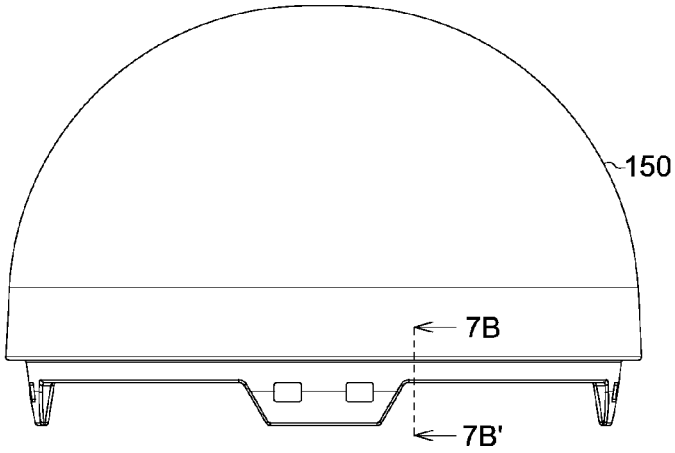
FIG. 7A illustrates an appearance diagram of a light cover according to another embodiment of the invention.
Figure 7B:
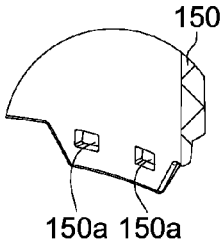
FIG. 7B illustrates a cross-sectional view of the light cover of FIG. 7A viewed along direction 7B-7B'.

Referring to FIGS. 7A and 7B. FIG. 7A illustrates an appearance diagram of a light cover according to another embodiment of the invention. FIG. 7B illustrates a cross-sectional view of the light cover of FIG. 7A viewed along direction 7B-7B'. The light cover 150 of the present embodiment is different from the light cover 150 of FIG. 1B in that the light cover 150 of the present embodiment has a plurality of independent engaging recesses 150*a*, and the first sub-hook 1211 (FIG. 1B) and the second sub-hook 1212 of the heat dissipation carrier 120 (FIG. 1B) may respectively be engaged with two engaging recesses 150*a*. In the present embodiment, the engaging recess 150*a* may be realized by a through hole. In another embodiment, the engaging recess 150*a* may be realized by a groove.

Figure 8A:
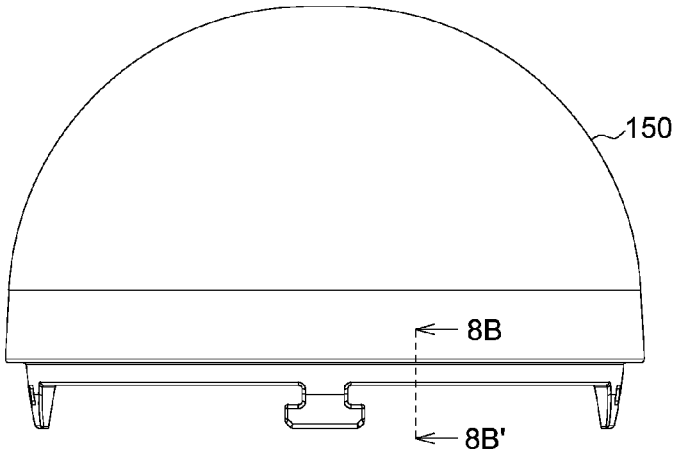
FIG. 8A illustrates an appearance of a light cover according to another embodiment of the invention.
Figure 8B:
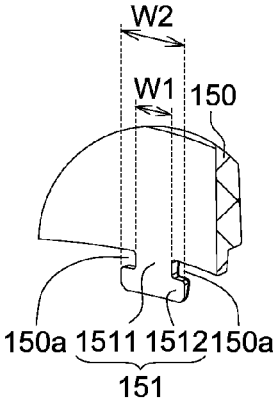
FIG. 8B illustrates a cross-sectional view of the light cover of FIG. 8A viewed along direction 8B-8B'.

Referring to FIGS. 8A and 8B. FIG. 8A illustrates an appearance of a light cover according to another embodiment of the invention. FIG. 8B illustrates a cross-sectional view of the light cover of FIG. 8A viewed along direction 8B-8B'. The light cover 150 of the present embodiment is different from the light cover 150 of FIG. 1B in that the light cover 150 of the present embodiment has a T-shaped engaging portion. In greater details, the light cover 150 comprises at least one engaging portion 151 having a T-shaped structure. For example, the engaging portion 151 comprises a vertical portion 1511 and a transverse portion 1512. The transverse width W1 of the vertical portion 1511 is less than the transverse width W2 of the transverse portion 1512, such that the engaging portion 151 may form two engaging recesses 150*a*. The first sub-hook 1211 (illustrated in FIG. 1B) and the second sub-hook 1212 (FIG. 1B) of the heat dissipation carrier 120 may be engaged with two engaging recesses 150*a* respectively.

Figure 9A:
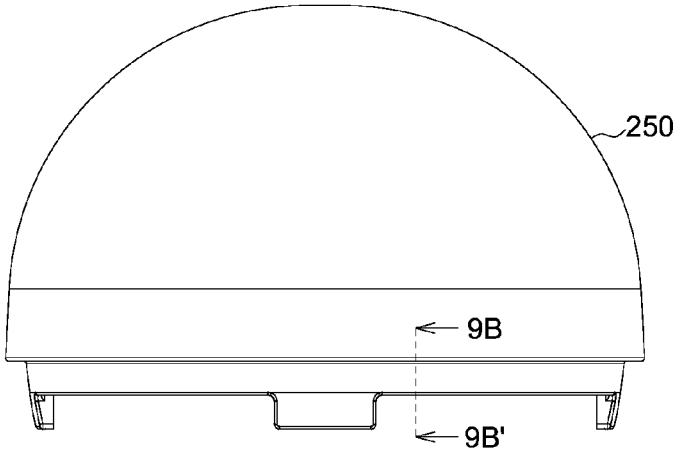
FIG. 9A illustrates an appearance diagram of a light cover according to another embodiment of the invention.
Figure 9B:
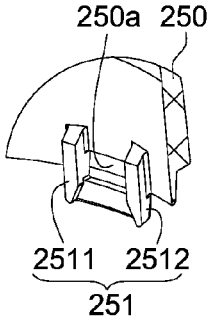
FIG. 9B illustrates a cross-sectional view of the light cover of FIG. 9A viewed along direction 9B-9B'.

Referring to FIGS. 9A and 9B. FIG. 9A illustrates an appearance diagram of a light cover according to another embodiment of the invention. FIG. 9B illustrates a cross-sectional view of the light cover of FIG. 9A viewed along direction 9B-9B'.

In the present embodiment, the light cover 250 has at least one engaging recess 250*a* and at least one engaging portion 251. The engaging recess 250*a* is realized by a groove. The engaging portion 251 comprises a first sub-engaging strip 2511 and a second sub-engaging strip 2512. The engaging recess 250*a* is formed between the first sub-engaging strip 2511 and the second sub-engaging strip 2512.

Figure 10A:
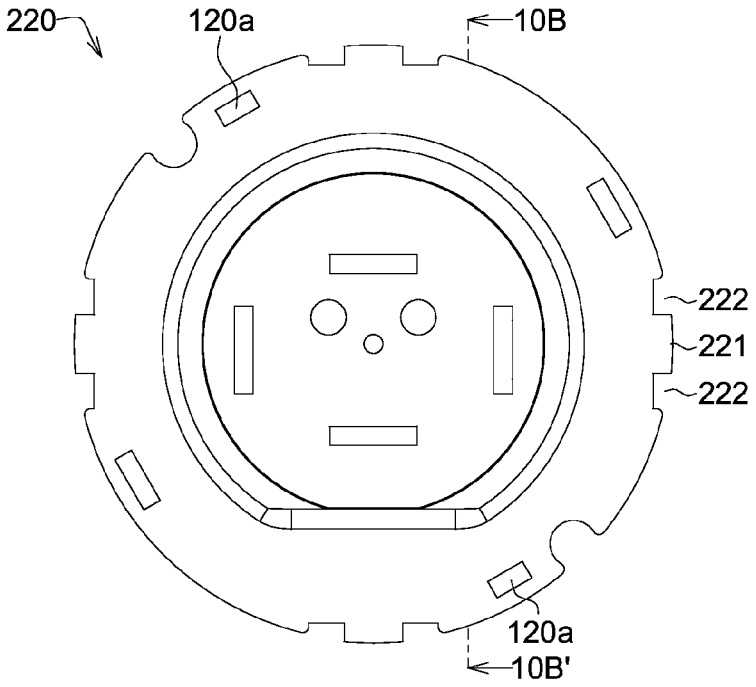
FIG. 10A illustrates a top view of a heat dissipation carrier according to another embodiment of the invention.
Figure 10B:
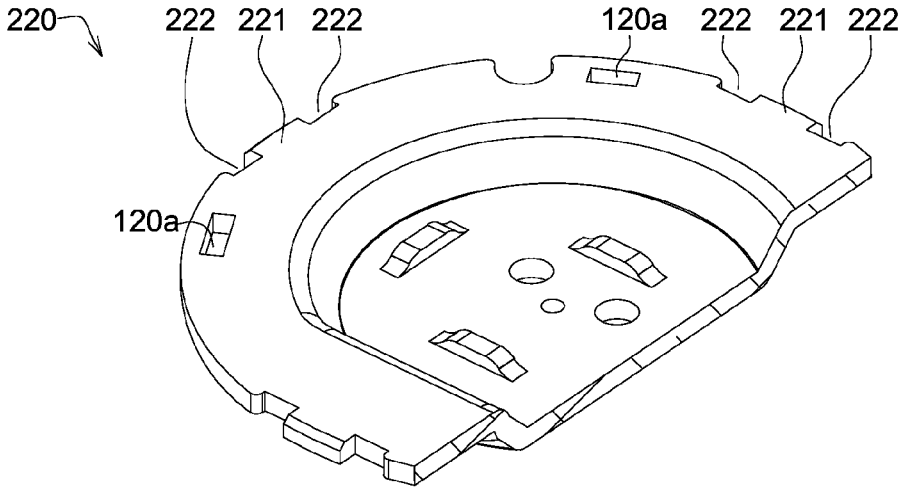
FIG. 10B illustrates a cross-sectional view of the heat dissipation carrier of FIG. 10A viewed along direction 10B-10B'.

Referring to FIG. 10A and FIG. 10B. FIG. 10A illustrates a top view of a heat dissipation carrier according to another embodiment of the invention. FIG. 10B illustrates a cross-sectional view of the heat dissipation carrier of FIG. 10A viewed along direction 10B-10B'. Unlike the heat dissipation carrier 120, the heat dissipation carrier 220 of the present embodiment omits the hook 121. Besides, the heat dissipation carrier 220 has at least one engaging protrusion 221 and at least one engaging recess 222. Each engaging protrusion 221 is located between two adjacent engaging recesses 222.

Figure 11:
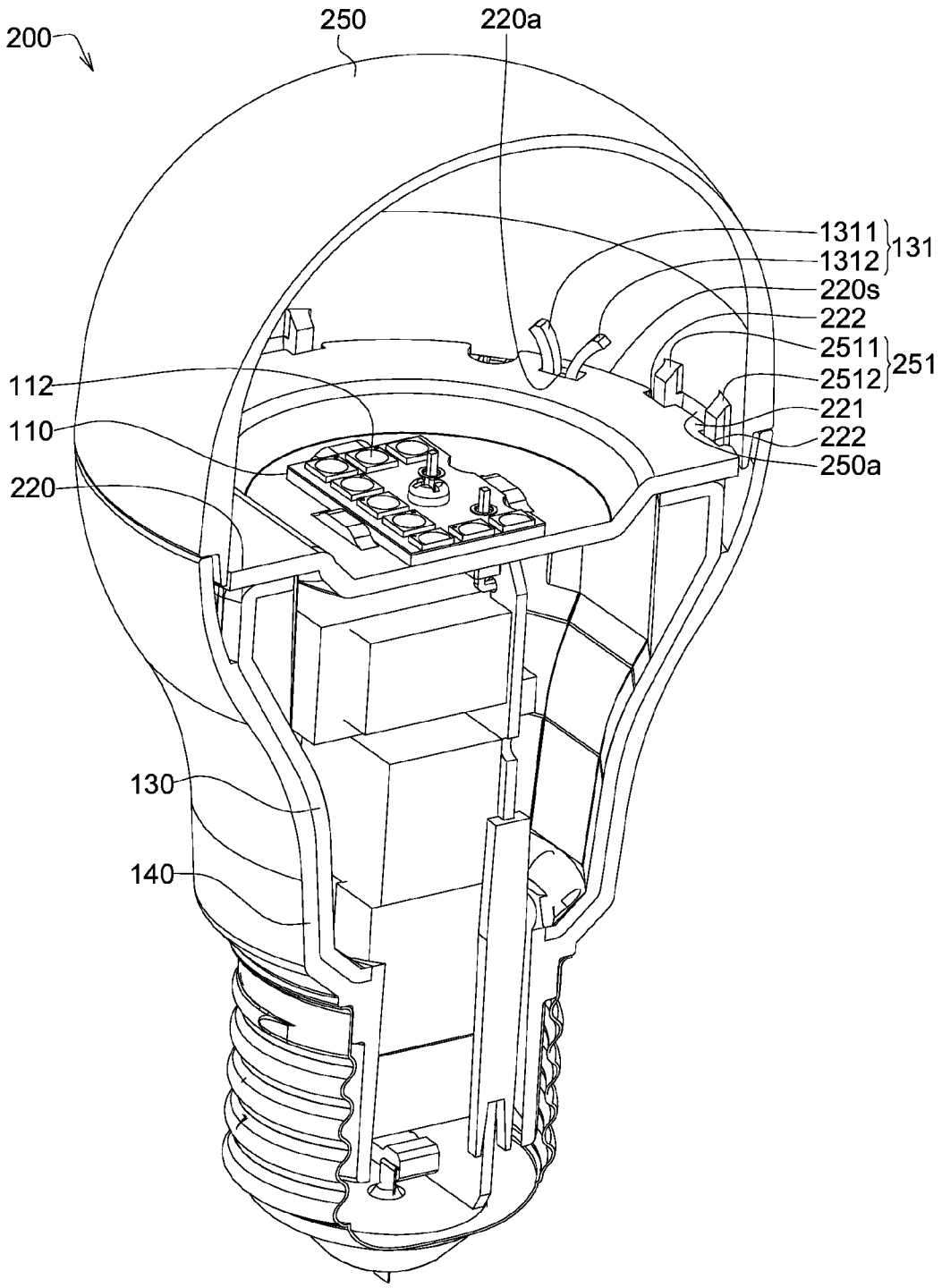
FIG. 11 illustrates a cross-sectional view of a light-emitting device according to another embodiment of the invention.

FIG. 11 illustrates a cross-sectional view of a light-emitting device according to another embodiment of the invention. The light-emitting device 200 comprises a circuit board 110, a plurality of light-emitting elements 112, a heat dissipation carrier 220, a side heat conduction plate 130, an insulation shell 140, a light cover 250 and a driver 160. The engaging protrusion 221 of the heat dissipation carrier 220 is engaged with the engaging recess 250*a* of the light cover 250. The first sub-engaging strip 2511 and the second sub-engaging strip 2512 of the light cover 250 respectively are engaged with two engaging recesses 222 of the heat dissipation carrier 220 to fix the relative position between the heat dissipation carrier 220 and the light cover 250. Moreover, the engaging portion 131 of the side heat conduction plate 130 penetrates the engaging through hole 220*a* which is engaged with the heat dissipation carrier 220. In comparison to the engaging through hole 120*a* of the heat dissipation carrier 120, the engaging through hole 220*a* of the present embodiment does not extend to the outer side 220*s* of the heat dissipation carrier 220.

Figure 12A:
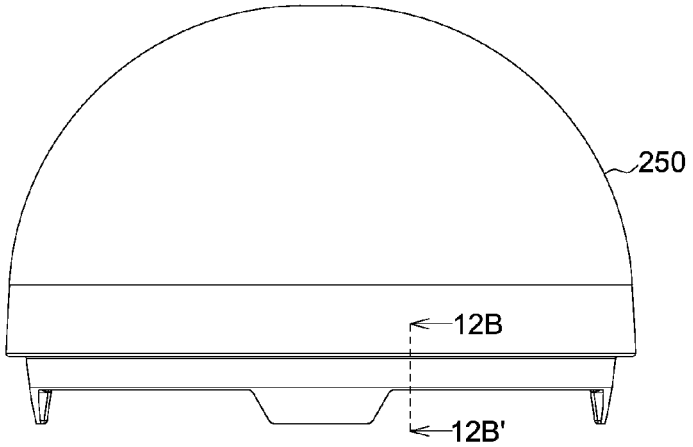
FIG. 12A illustrates an appearance of a light cover according to another embodiment of the invention.
Figure 12B:
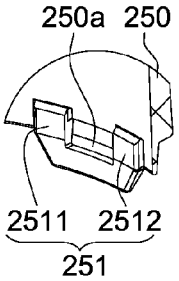
FIG. 12B illustrates a cross-sectional view of the light cover of FIG. 12A viewed along direction 12B-12B'.

Referring to FIGS. 12A and 12B. FIG. 12A illustrates an appearance of a light cover according to another embodiment of the invention. FIG. 12B illustrates a cross-sectional view of the light cover of FIG. 12A viewed along direction 12B-12B'. The light cover 250 of the present embodiment has at least one engaging recess 250*a* and at least one engaging strip 251 for engaging with the engaging protrusion 221 and the engaging recess 222 of the heat dissipation carrier 220 of FIG. 10A in a similar way of engaging the light cover 250 and the heat dissipation carrier 220 of FIG. 11, and the similarities are not repeated here.

Figure 13A:
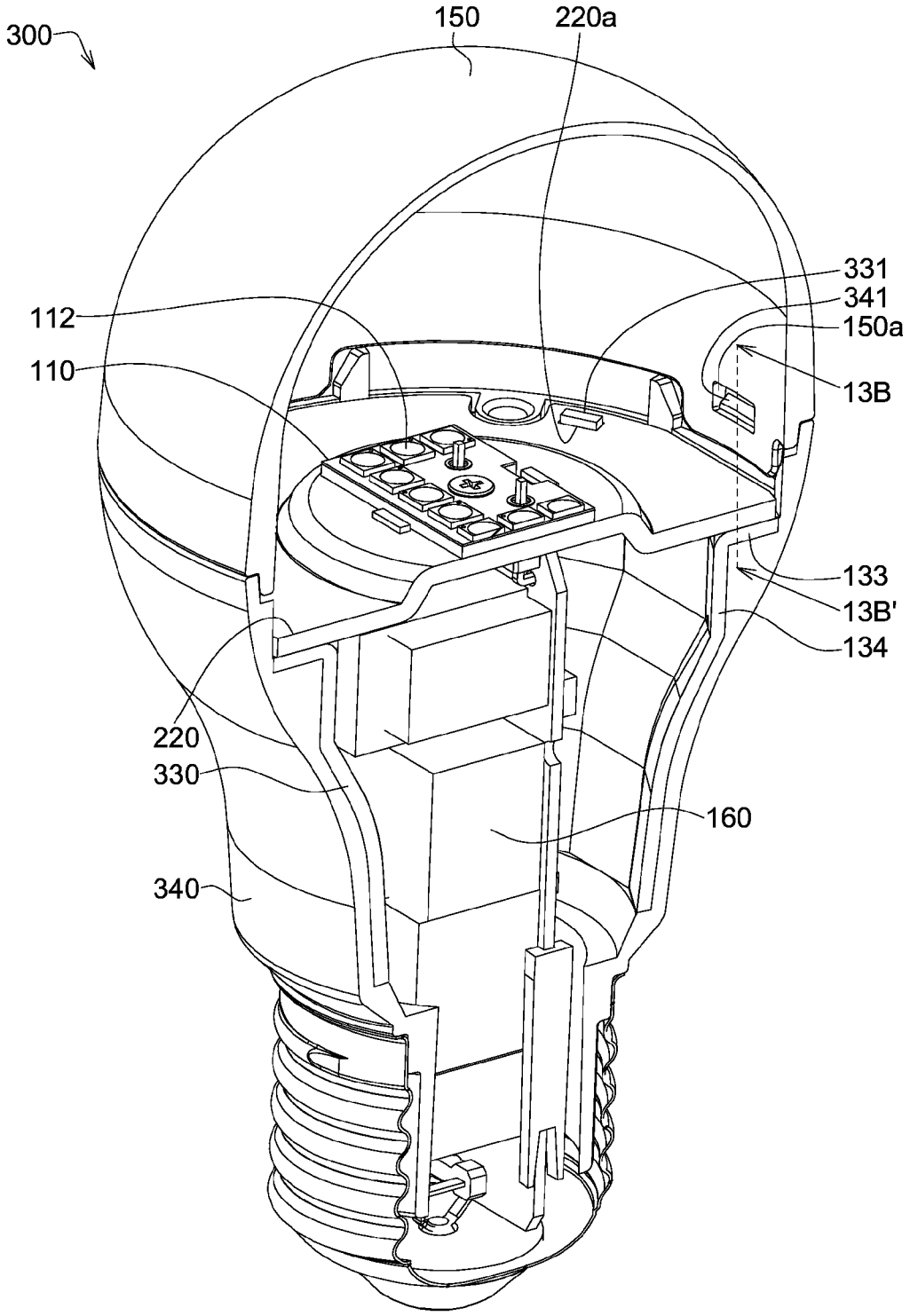
FIG. 13A illustrates a cross-sectional view of a light-emitting device according to another embodiment of the invention.
Figure 13B:
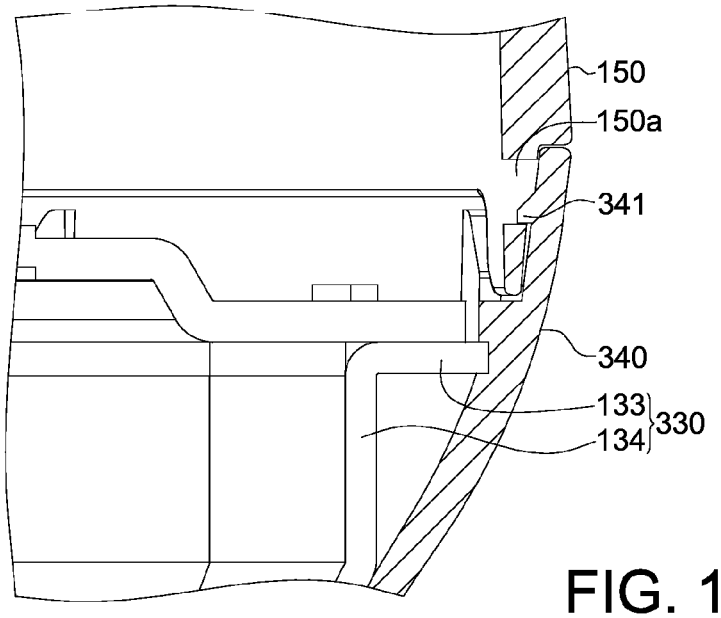
FIG. 13B illustrates a cross-sectional view of the light-emitting device of FIG. 13A viewed along direction 13B-13B'.

Referring to FIGS. 13A and 13B. FIG. 13A illustrates a cross-sectional view of a light-emitting device according to another embodiment of the invention. FIG. 13B illustrates a cross-sectional view of the light-emitting device of FIG. 13A viewed along direction 13B-13B'. The light-emitting device 300 comprises a circuit board 110, a plurality of light-emitting elements 112, a heat dissipation carrier 220, a side heat conduction plate 330, an insulation shell 340, a light cover 150 and a driver 160.

The light cover 150 of the present embodiment has at least one engaging recess 150*a* which is a through hole. The insulation shell 340 comprises at least one hook 341 engaged with the engaging recess 150*a* from the outer side of the light cover 150 to fix the relative position between the light cover 150 and the insulation shell 340. The side heat conduction plate 330 comprises at least one engaging portion 331, a transverse plate 133 and a side plate 134. Unlike the side heat conduction plate 130, the transverse plate 133 of the side heat conduction plate 330 of the present embodiment is bent outwardly with respect to the side plate 134 to carry the circuit board 110.

The heat dissipation carrier 220 may be engaged with the side heat conduction plate 330. For example, the heat dissipation carrier 220 has at least one engaging through hole 220*a*, and the engaging portion 331 of the side heat conduction plate 330, being an engaging stud, is engaged with the engaging through hole 220*a* of the heat dissipation carrier 220 to fix the relative position between the heat dissipation carrier 220 and the side heat conduction plate 330. In another embodiment, the structure of the engaging portion 331 of the side heat conduction plate 330 may be similar to that of the engaging portion 131. Under such design, the way of engaging the engaging portion 331 and the engaging through hole 220*a* may be similar to the way of engaging the engaging portion 131 and the engaging through hole 120*a* (FIG. 1B), and the similarities are not repeated here.

Figure 14:
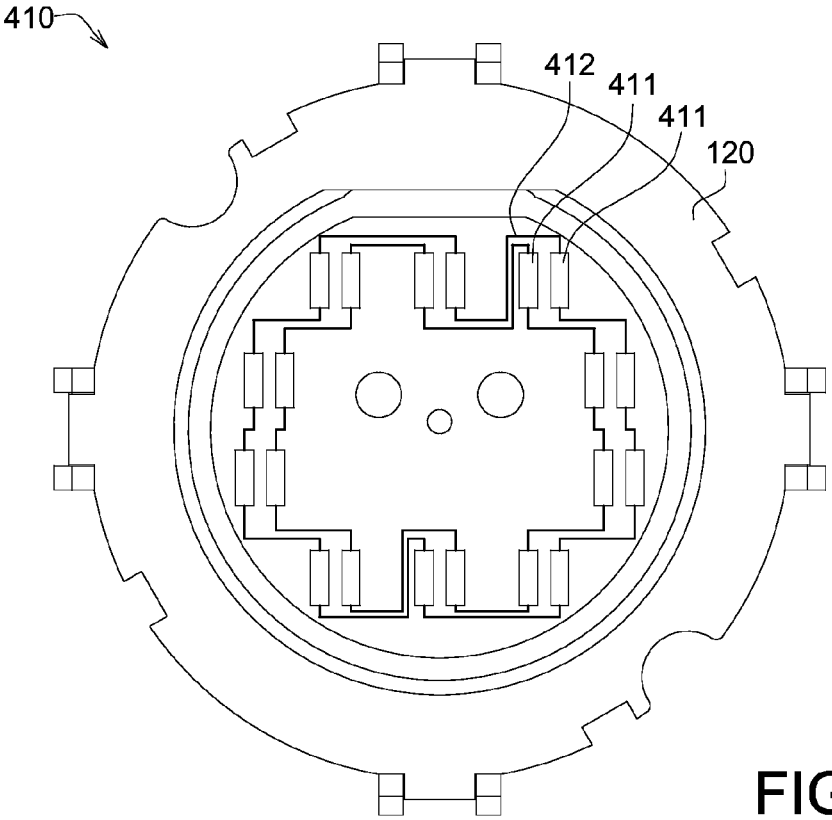
FIG. 14 illustrates a top view of a heat dissipation circuit board according to an embodiment of the invention.

FIG. 14 illustrates a top view of a heat dissipation circuit board according to an embodiment of the invention. The heat dissipation circuit board 410 comprises a heat dissipation carrier 120, a plurality of electric pads 411 and a wire 412. The wire 412 connects the electric pads 411 in parallel or in series. The light-emitting element 112 (illustrated in FIG. 1B) may be disposed on the electric pad 411 and electrically connected with the driver 160 (illustrated in FIG. 1B) through the wire 412. To put it in greater details, the heat dissipation circuit board 410 may be realized by such as a metal substrate or a glass fiber substrate. The metal substrate may be realized by such as a metal core PCB (MCPCB), and the glass fiber substrate may be realized by such as an FR4 substrate, a CEM1 substrate or a CEM3 substrate.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A light-emitting device, comprising:
- a heat dissipation carrier;
- a circuit board disposed on the heat dissipation carrier;
- at least one light-emitting element disposed on the circuit board;
- a side heat conduction plate engaged with the heat dissipation carrier, and comprising:
  - a transverse plate carrying the circuit board; and
  - a side plate connected with the transverse plate;
- a light cover directly engaged with the heat dissipation carrier, wherein the light cover has an engaging recess, and the heat dissipation carrier comprises at least one hook which is engaged with the engaging recess; and
- an insulation shell at least covering the side plate of the side heat conduction plate.

2. The light-emitting device according to claim 1, wherein the side plate of the side heat conduction plate comprises:
- an upper portion connected with the transverse plate and placed in a vertical orientation;
- a lower portion placed in an inclined orientation; and
- a connection plate connecting the upper portion with the lower portion, and having a curved surface.

3. The light-emitting device according to claim 2, wherein the lower portion has a positioning through hole for fixing the relative position between a mold and the side heat conduction plate.

4. The light-emitting device according to claim 2, wherein the connection plate has a mold flow through hole.

5. The light-emitting device according to claim 1, wherein the side heat conduction plate comprises a plurality of sub heat dissipation plates arranged in an annular shape, each of the sub heat dissipation plates comprises a protrusion and a recess, and the protrusion of one of the sub heat dissipation plate is engaged with the recess of the adjacent sub heat dissipation plate.

6. The light-emitting device according to claim 1, wherein an upper portion of the side plate is separated from the insulation shell.

7. The light-emitting device according to claim 1, wherein the engaging recess of the light cover is a through hole or a groove.

8. The light-emitting device according to claim 1, wherein the heat dissipation carrier is formed by using a sheet metal processing capable of easily forming the at least one hook.

9. The light-emitting device according to claim 1, wherein the heat dissipation carrier further comprises:
- a carrier plate having an upper surface for carrying the circuit board; and
- a protruding portion projected from a lateral surface of the carrier plate;
- wherein, the hook comprises a first sub-hook and a second sub-hook, and the first sub-hook and the second sub-hook are connected with two opposite sides of the protruding portion respectively and projected toward a direction away from the upper surface of the carrier plate.

10. The light-emitting device according to claim 1, wherein the light cover comprises a T-shaped engaging portion having a first and a second engaging recess, and the hook comprises a first sub-hook and a second sub-hook which respectively are engaged with the first and the second engaging recesses of the T-shaped engaging portion.

11. The light-emitting device according to claim 1, wherein the light cover comprises an engaging portion comprising a vertical portion and a transverse portion, and a transverse width of the vertical portion is less than that of the transverse portion, making the engaging portion capable of forming a first and a second engaging recess.

12. The light-emitting device according to claim 1, wherein the light cover comprises an engaging portion, the engaging portion comprises a first sub-engaging strip and a second sub-engaging strip, and the engaging recess is formed between the first sub-engaging strip and the second sub-engaging strip.

13. The light-emitting device according to claim 1, wherein the heat dissipation carrier comprises a plurality of stopper protrusions, and the circuit board is located among the stopper protrusion.

14. The light-emitting device according to claim 1, wherein the heat dissipation carrier has an engaging through hole, the side heat conduction plate comprises a first engaging arm and a second engaging arm opposite to the first engaging arm, and the first engaging arm and the second engaging arm expand outwardly, such that a distance between the first engaging arm and the second engaging arm is greater than an inner diameter of the engaging through hole for the first engaging arm and the second engaging arm being engaged with the engaging through hole.

15. The light-emitting device according to claim 14, wherein the side heat conduction plate is formed by using a sheet metal processing capable of easily forming the first engaging arm and the second engaging arm.

16. The light-emitting device according to claim 1, wherein the heat dissipation carrier has a plurality of engaging protrusions and a plurality of the engaging recesses, and each of the engaging protrusions is positioned between two adjacent engaging recesses.

17. The light-emitting device according to claim 1, wherein the circuit board has a first through hole and a second through hole, the heat dissipation carrier has a third through hole and a fourth through hole, and the light-emitting device further comprises:
- a driver comprising a first pin and a second pin, wherein the first pin penetrates the first through hole and the third through hole, and the second pin penetrates the second through hole and the fourth through hole.

18. The light-emitting device according to claim 1, further comprising:
- an electric pad formed on the heat dissipation carrier;
- wherein, the at least one light-emitting element is disposed on and electrically connected with the electric pad.

19. The light-emitting device according to claim 1, wherein the side heat conduction plate comprises an engaging stud, the side heat dissipation carrier has an engaging through hole, the engaging stud of the side heat conduction plate is engaged with the engaging through hole of the heat dissipation carrier to fix a relative position between the heat dissipation carrier and the side heat conduction plate.

* * * * *